US006754972B2

(12) United States Patent
Donnellan

(10) Patent No.: US 6,754,972 B2
(45) Date of Patent: Jun. 29, 2004

(54) TILING AID

(76) Inventor: Anthony Donnellan, Maskells Farmhouse, Boxford Lane, Boxford, Suffolk (GB), CO10 5JY ( * ) Notice: Subject to any disclaimer, the term of this patent is extended or adjusted under 35 U.S.C. 154(b) by 0 days.

(21) Appl. No.: 10/009,646

(22) PCT Filed: May 2, 2001

(86) PCT No.: PCT/GB00/01678

§ 371 (c)(1),
(2), (4) Date: May 15, 2002

(87) PCT Pub. No.: WO01/09460

PCT Pub. Date: Feb. 8, 2001

(65) Prior Publication Data

US 2002/0148129 A1 Oct. 17, 2002

(30) Foreign Application Priority Data

Apr. 30, 1999 (GB) ..... 9909989
May 11, 1999 (GB) ..... 9910892

(51) Int. Cl.[7] ..... G01B 5/16
(52) U.S. Cl. ..... 33/526; 33/562
(58) Field of Search ..... 33/526, 429, 474, 33/481, 527, 562

(56) References Cited

U.S. PATENT DOCUMENTS 2,466,919 A * 4/1949 Sykes ..... 33/526
2,852,932 A * 9/1958 Cable ..... 33/526
4,233,792 A 11/1980 Malavasi
4,712,309 A * 12/1987 Kingston et al. ..... 33/527
5,797,192 A * 8/1998 Curtis ..... 33/526
6,494,015 B1 * 12/2002 Critchlow ..... 33/481

FOREIGN PATENT DOCUMENTS

| | | |
|---|---|---|
| CH | 579 693 | 7/1976 |
| DE | 1 908 769 | 1/1965 |
| DE | 27 24 128 A1 | 5/1977 |
| EP | 0 617 182 A1 | 9/1994 |
| EP | 0 544 604 A1 | 6/1996 |
| GB | 2 228 953 A | 9/1990 |
| GB | 2253878 | 9/1992 |
| GB | 2 279 375 A | 1/1995 |

OTHER PUBLICATIONS

International Preliminary Examination Report for PCT/GB00/01678.

* cited by examiner

*Primary Examiner*—Christopher W. Fulton
(74) *Attorney, Agent, or Firm*—Myers Bigel Sibley & Sajovec

(57) ABSTRACT

A tiling guide to aid the placement of tiles on to a surface comprises an elongate substantially flat strip having fixing means to secure the guide to a surface. The guide is provided with a ridge against which a tile can be aligned, and is so sized as to be obscured from view following conventional grouting. The ridge may be provided with a series of cut-outs, and preferably has a castellated shape to enable the guide to be rolled up during storage and transportation. Fixing means is preferably in the form of a layer of adhesive protected prior to use by a peelable paper strip.

18 Claims, 4 Drawing Sheets

TILING AID

CROSS-REFERENCE TO RELATED APPLICATIONS

The present application is a U.S. national phase application of PCT International Application No. PCT/GB00/01678, having an international filing date of May 2, 2000 and claiming priority to Great Britain Application No. 9909989.7 filed Apr. 30, 1999, and Great Britain Application No. 9910892.0 filed May 11, 1999, the disclosures of which are incorporated herein by reference in their entireties. The above PCT International Application was published in the English language and has International Publication No. WO 01/09460.

FIELD OF THE INVENTION

The present invention relates to a tiling aid and in particular to a guide to ensure the correct alignment of tiles when tiling a surface. It further relates to an improved method of tiling a surface.

BACKGROUND OF THE INVENTION

When tiling a wall a D.I.Y. enthusiast or a professional tiler is normally faced with the problem of placing the first tile "square-on", that is ensuring that the edges of the tile are correctly aligned. For example, when tiling a wall using square tiles, this entails ensuring that the edges of the tile lie in a horizontal or a vertical plane.

Similarly, when tiling a floor or indeed any other tileable surface, the initial problem of orientation of the first tile will always arise. The problem cannot be overcome by simply placing the first tile in a corner of the surface to be covered as most corners in a building tend not to have perfect right angles. To start tiling from such a position would inevitably cause problems by the time the tiles had reached the diametrically opposite corner. Therefore D.I.Y. enthusiasts and professional tilers always start tiling away from a corner.

Solutions to the above problem have been proposed. For example, where an edge of the surface to be tiled is defined by a lip of a bath, it is usually assumed (sometimes incorrectly) that the bath has been correctly levelled. In this case the first row of tiles is simply "butt-up", that is an edge of the tile is aligned against the lip of the bath. Plumb lines can also be used where there is no convenient horizontal or vertical marker. Where the surface to be tiled is a floor, then set squares can be used.

Nevertheless, if there is nothing against which each tile in a particular row or column can "butt-up". The problem may arise of a non-flush row or column of tiles being initially created. This causes any subsequent rows or columns of tiles which "butt-up" against the first row or column to also be non-flush leading to a finish that is not aesthetically pleasing.

In essence, the laying of the first tile and the first row or column of tiles is all important when tiling a surface and none of the conventional solutions associated with establishing this first tile and first row or column of tiles overcome the problems as outlined above. At best, the tiler spends an inordinate amount of time establishing this first row or column of tiles.

The present invention seeks to overcome the problems as outlined above and to provide a solution to this problem of benefit to the D.I.Y. enthusiast and expert alike.

SUMMARY OF THE INVENTION

According to a first aspect of the present invention there is provided a tiling guide to aid the placement of tiles onto a surface, the guide having surface engaging means which enables the guide to be secured to a surface characterised in that the guide comprises tile abutment means to align the edge of a tile and one or more substantially flat elongate portions, each portion having a tile-engaging side and a surface-engaging side, the guide being so sized as to be completely obscured from view once the completed tiling has been conventionally grouted.

The tile abutment means conveniently comprises a ridge extending from the tile-engaging side. The ridge is advantageously located along the central longitudinal axis of the guide. Preferably, the ridge comprises one or more discontinuities along its length. Such an arrangement minimises the amount of material required to produce any one particular guide. The ridge particularly advantageously has a castellated cross-section along its length, which allows the guide to be more easily rolled up for storage purposes. The ridge advantageously has a "T"-shaped cross-section in the plane perpendicular to its longitudinal axis, to allow grout to key into the guide.

In a preferred embodiment of the convention, the guide comprises two non-parallel elongate portions. The angle subtended between the two non-parallel elongate portions is conveniently selected from the group comprising 60°, 45°, 90° and 120°.

In a particularly preferred embodiment, the guide consists of one elongate portion.

Preferably, the or each end of the guide is provided with one or markings to enable the or each end to be cut away at a specific angle. In this manner other guides are able to contact the cut end at this particular angle.

Preferably, the fixing means comprises an adhesive along the surface engaging side of the guide. Prior to use, the adhesive is conveniently protected by a removable protective sheet.

The guide is preferably formed from a plastics material.

According to a second aspect of the present invention there is provided a method of tiling a surface comprising the steps of:

establishing a line on or adjacent the surface to be tiled;

securing a tiling guide of the type specified herein above to the surface using the established line to assist alignment of the guide;

applying adhesive to the surface to be tiled;

aligning one or more tiles along the guide;

tiling the remainder of the surface; and applying grout to fill in the space between the tiles and obscure the guide from view, whereby an initial tile or tiles having the correct alignment can be rapidly established from which initial tile or tiles subsequent tiles can be aligned.

Conveniently, the tile is aligned by abutment against an outwardly extending ridge located on the tiling guide.

Optionally, the second tiling guide is secured at an angle adjacent the tiling guide to enable two edges of a tile to be aligned.

The invention further includes within its scope a pack of tiles incorporating a tiling guide of the type specified above.

BRIEF DESCRIPTION OF THE DRAWINGS

Preferred embodiments of the invention will now be more particularly described by way of example only, with reference to the accompanying sheets of drawings wherein.

DETAILED DESCRIPTION OF THE PREFERRED EMBODIMENTS

Throughout the specification, the use of the word "integral" is intended to cover not only something which is formed from the outset as one single-entity component, but also anything which, whilst being assembled from a plurality of initially separate independent integers, ends up as a single and normally non-demountable structure.

Figure 1:
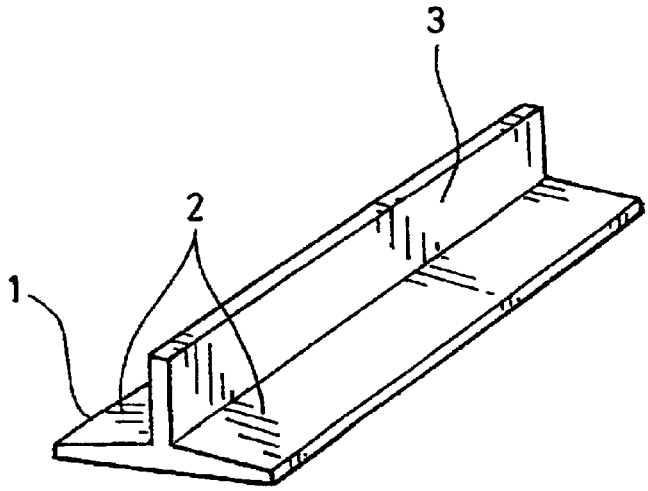
FIG. 1 is a perspective view of one embodiment of the present invention.

FIG. 1 illustrates a tiling guide to aid the fitment of tiles on to a surface and is generally referenced 1. The guide comprises an elongate substantially flat strip whose in-use outer surface 2 is slightly bevelled and angled away from the lower surface. The centre of the guide 1 is provided with an integral ridge 3 located on the outer surface 2 of the guide 1 and continuous along its length. The top surface of the ridge 3 is substantially parallel to the lower surface of the strip throughout its entire length.

Figure 2:
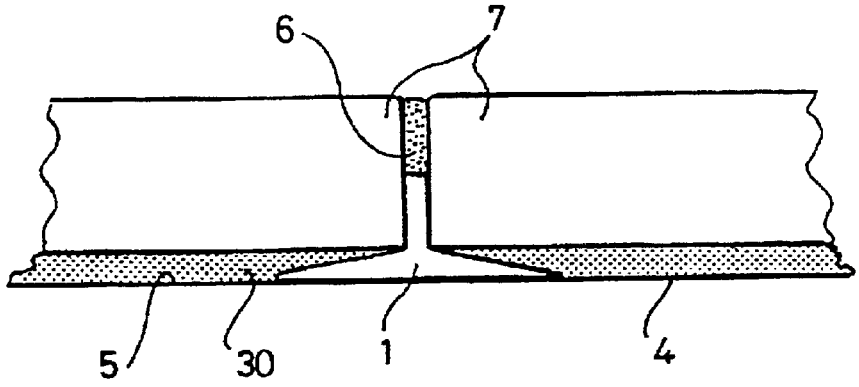
FIG. 2 is an end view of the embodiment illustrated in FIG. 1 in use, once the completed tiling has been conventionally grouted.

FIG. 2 shows the guide 1 in use on a surface 5 when tiles 7 are applied, the tiles 7 being held to the surface 5 by a layer of adhesive 30. The ridge 3 is of sufficient dimensions to enable an edge of a tile 7 to "butt-up" against it without the ridge 3 deforming in any noticeable fashion. The height of the ridge 3 is approximately half the height of the thickness of the tile 7. Conventional grout 6 fills in the remaining gap between the top of the tiles 7 and covers the top of the ridge 3 such that the grout 6 completely obscures from view, the tile guide 1.

Figure 3:
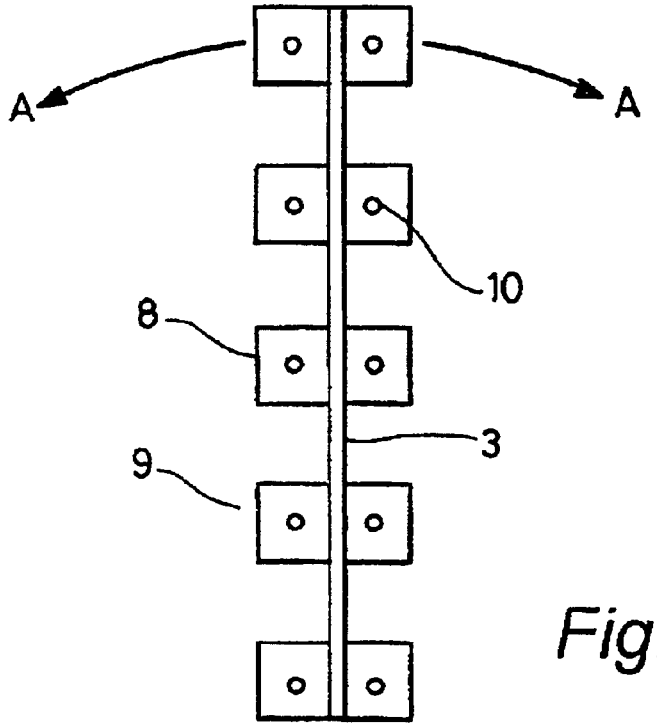
FIG. 3 is a plan view of an alternative embodiment of the present invention that is capable of being fixed to a surface in a non-rectilinear manner.

In an alternative embodiment, illustrated in FIG. 3 and generally referenced 9 the elongate flat strip has a series of cut-outs along its length. The remaining sections 8 of the strip have fixing holes 10 to enable the guide 1 to be screwed or hammered on to a surface. The cut-outs enable a degree of flexibility in the direction denoted by the arrows "A" when securing the guide 1 to a surface 5. Therefore, the ridge 3 need not necessarily be in the form of a substantially rectilinear surface against which a tile can butt-up but can be bent to allow for curved tiles (or tiles cut into the curved shape) to fit the curved ridge 3 created.

Figure 4:
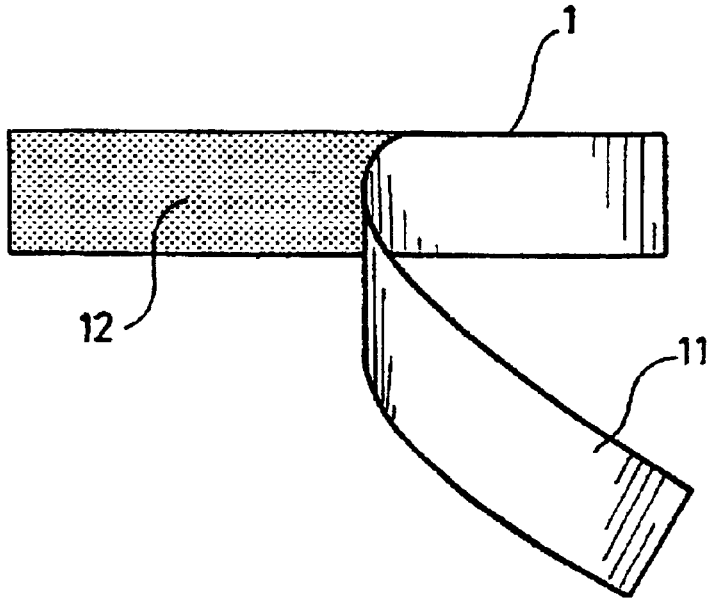
FIG. 4 illustrates the wall engaging surface of the embodiment illustrated in FIGS. 1 and 2 with the partial removal of a protective strip of material exposing an adhesive layer.

FIG. 4 illustrates another means of fixing the guide 1 to a surface 5 prior to the tiling of the surface 5. In FIG. 4, the substantially flat elongate strip has a peelable strip of paper 11 of the type generally known per se which can be removed from the guide 1 to expose a pre-gummed or otherwise pre-glued surface 12 to enable the guide 1 to be stuck to the surface 5. This obviates the need for a plurality of countersunk apertures running the length of the guide 1, either side of the ridge 3, and as illustrated in FIG. 3.

Figure 5:
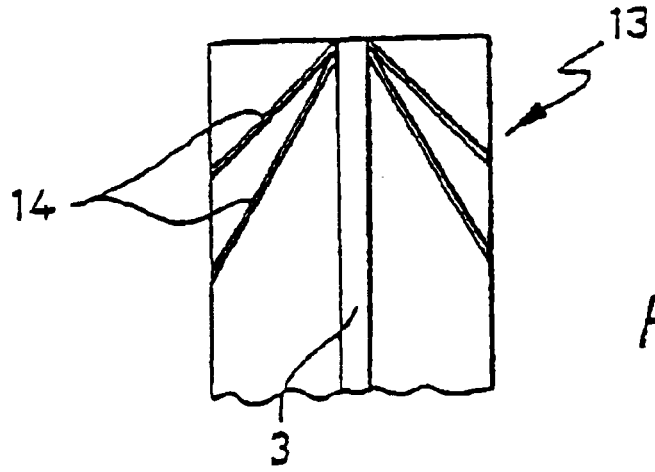
FIG. 5 is a plan view of part of an alternative embodiment of the present invention.
Figure 6:
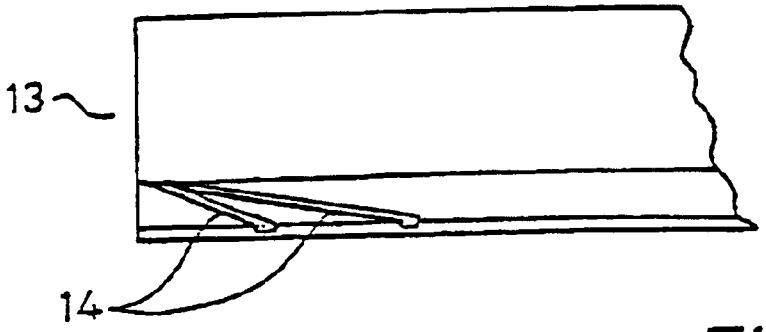
FIG. 6 is a side view of that which is shown in FIG. 5 to emphasise the grooved cut-outs.

FIGS. 5 and 6 illustrate part of a further alternative embodiment generally referenced 13, wherein at least one end of the guide 1 is provided with markings. In this case the markings comprise a series of straight grooves 14 set at specific angles to the longitudinal axis of the ridge 3, most notably 45° and 60°. Placing a cutting implement, for example a Stanley™ knife, hacksaw blade etc. along the grooves 14 and sawing along the grooves 14 will result in a new, cut guide 1, that can be placed adjacent or in otherwise contiguous contact with another guide 1 (cut or uncut), to enable tiles cut at the angle subtended by the two guides 1, 1 to be slid and "butted-up" into place.

Figure 7:
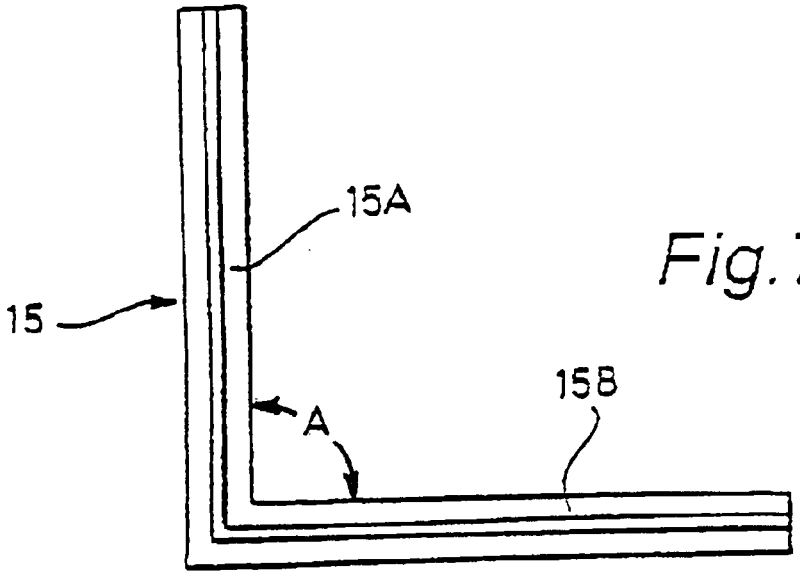
FIG. 7 is a plan view of a further alternative embodiment of the present invention, having an integral 90° angle.

In FIG. 7, the integral guide 15 has two non-parallel portions, 15A, 15B the angle A between portions 15A, 15B being 90°.

Alternative non-illustrated embodiments of the present invention will now be described which do not depart from the scope of the present invention. The ridge 3 need not necessarily be continuous or substantially parallel throughout its length. The ridge 3 could be provided with a number of cut-outs that could for example, result in a sloping top edge, or a curved or fluted top edge.

The angled outer surface 2 of the guide 1 as shown in FIG. 1, is so angled to allow grout 6 to occupy as much of the outer surface 2 of the guide 1 as possible (see FIG. 2). Alternatively, the outer surface 2 could be provided with a number of ribbed or grooved cut-outs running along the longitudinal length of the guide 1 to enable grout 6 to key-in to the guide 1.

The edge of the ridge 3 against which the tile 7 "butts-up" need not necessarily be flat as illustrated in the Figures and could also incorporate a number of ribbed or grooved cut-outs to aid the keying in of grout 6. In one embodiment, the ridge 3, when seen end on (as illustrated in FIG. 2) has a "T" shaped cross-section which enables grout 6 to fill the gaps separating the head of the "T" from the stem of the "T".

The angle A subtended by the guide 1 in FIG. 7 need not necessarily be 90° and could, for example, be selected from the group comprising 60°, 45°, 90° and/or 120°.

Furthermore, these angles could also apply to the grooves 14 illustrated in FIG. 5. This enables a non-integral pair of guides 1 to achieve the same end result as the integral guide generally referenced 15 having two elongate portions 16A, 16B at right angles to each or the end illustrated in FIG. 7, i.e., that of a fixed angle.

When using a guide of the type herein described, a plumb-line can initially be used to establish a straight line on a wall. The guide can then be secured to the wall using the plumb-line as a guide and tiling commenced in the manner described herein. Alternatively, the plumb-line can be used to cast a shadow on the wall and a vertical line drawn with a pencil on to the wall to help the placement of the guide. A set square can be used in a similar manner when tiling a floor.

For the avoidance of doubt, the term grouting is intended to include conventional grouting and "in-fill" with sand/dirt brushed into place with a broom for patio type tiling as demonstrated by the "ground-force" team on BBC television. Similarly a tile is intended to include paving slabs.

Figure 9:
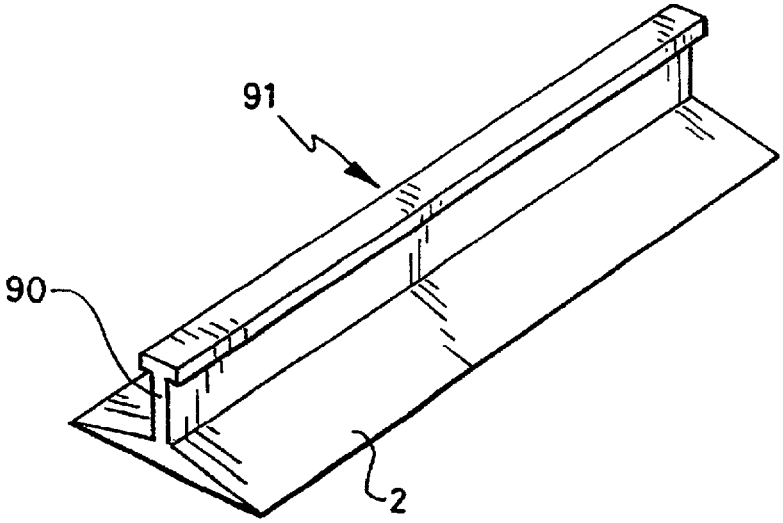
FIG. 9 is a perspective view of a guide having a T-shaped ridge.

Furthermore, in alternative embodiments, the upper in use surface of the ridge 3 could also be ribbed or otherwise provided with a number of cut outs to also aid the keying in of the grout 6. As shown in FIG. 9 the ridge 90 of the guide 91 can have a "T"-shaped cross-section to enable the grout to key in. The angle subtended by the outer surface 2 with the surface being tiled is typically 2–10°.

In further alternative embodiments not illustrated, the guide 1 can be provided with a pair of parallel grooved cut-outs running the length of the guide 1 and located on either side of the ridge 3. Each respective one of the pair of grooved cut-outs is located adjacent the ridge 3 so that once the tile has been positioned against the ridge 3, the ridge 3 can be cut away with the aid of a sharp knife by simply running the sharp knife down the longitudinal axis of the guide 1 along the length of the cut-out adjacent the ridge 3.

The guide 1 can be made from plastics material, preferably a thermoplastic plastics material and may be formed into the required shape by extrusion from a mould. As an alternative to, or in addition to cut-outs or indentations, the plastics material from which the guide is formed can be sufficiently pliable so that the guide 1 can be curved in the plane of the surface covered so that curved tiles may be more easily placed.

The pliability of the guide 1 can be such that when it is not in use, e.g. packed for sale, the guide 1 could be rolled up into a spiral, the axis of the spiral being perpendicular to the longitudinal axis of the guide.

Figure 8:
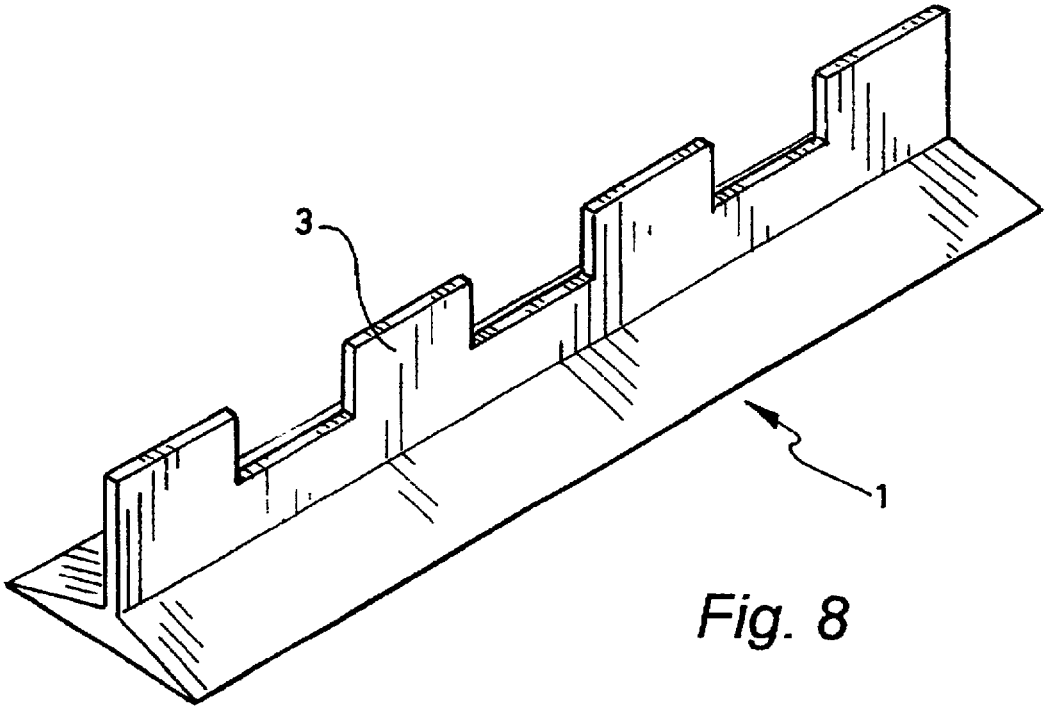
FIG. 8 illustrates a further alternative embodiment of the present invention to emphasise a different type of cut-out.

In order to assist rolling-up of the guide along its longitudinal axis, the ridge 3 of a guide 1 may comprise a number of cut-outs or indentations. An example of this is shown in FIG. 8 where the ridge 3 has a castellated appearance. When the strip of material is rolled up onto a spiral, the indentations reduce the stress along the ridge 3 which would otherwise resist the rolling process and/or cause plastic flow and hence deformation of the ridge 3.

Such a spiral of material could be sold in conventional see-through plastics cartons, or sold with boxes of tiles as an additional feature. Furthermore, as an alternative to the provision of the guides 1 in rolled up spirals, they can be sold in very short lengths, each respective end of each respective length being provided with a male-female interference type fit so that each respective length can be "clipped" together to form one long strip.

It will of course be understood that the invention is not limited to these specific details described herein, which are given by way of example only, and that various modifications and alterations are possible within the scope of the appended claims.

What is claimed is:

1. A tiling guide to aid the placement of tiles onto a surface, the tiling guide comprising surface-engaging means which enable the tiling guide to be secured to the surface, one or more substantially flat elongate portions each having a tile engaging side and a surface engaging side, and tile abutment means to align the edge of a tile, wherein the tile abutment means comprises a ridge extending away from the tile engaging side, and wherein the ridge has a T-shaped cross-section, the T-shape allowing grout to key into the tiling guide.

2. A tiling guide according to claim 1 wherein the tiling guide is sufficiently pliable that it may be rolled into a spiral when not in use.

3. A tiling guide according to claim 1 wherein the tiling guide comprises two non-parallel substantially flat elongate portions.

4. A tiling guide according to claim 1 wherein the tiling guide comprises a single elongate portion.

5. A tiling guide according to claim 1 wherein the or each end of the tiling guide is provided with one or more markings to enable the or each end to be cut away at a specific angle.

6. A tiling guide according to claim 1 wherein the surface-engaging means comprises an adhesive along the surface-engaging side of the tiling guide.

7. A tiling guide according to claim 6 wherein prior to use of the tiling guide the adhesive is protected by a removable sheet.

8. A tiling guide according to claim 1 wherein the or each elongate portion comprises a number of cut outs along the or each edge to enable the tiling guide to bent into a desired curved shape.

9. A tiling guide according to claim 1, wherein the tile engaging side of the tiling guide is roughened by means of scratches or grooves.

10. A tiling guide according to claim 1 wherein the tile engaging side subtends an angle of from 2 to 10° with the surface.

11. A method of tiling comprising the steps of:

establishing a line on or adjacent the surface to be tiled;

securing a tiling guide to the surface using the established line to assist alignment of the tiling guide, the tiling guide comprising a single elongate member having surface-engaging means which enable the tiling guide to be secured to the surface, one or more substantially flat elongate portions each having a tile engaging side and a surface engaging side, and tile abutment means to align the edge of a tile, wherein the tiling guide is sufficiently pliable that it may be rolled into a spiral when not in use;

applying adhesive to the surface to be tiled;

aligning one or more tiles along the tiling guide;

tiling the remainder of the surface; and applying grout to fill in space between the tiles;

wherein the step of applying trout includes obscuring the tiling guide from view with the grout.

12. A method of tiling according to claim 11 wherein the tile is aligned by abutment against an outwardly extending ridge located on the tiling guide.

13. A method of tiling according to claim 11 wherein a second tiling guide is secured at an angle, adjacent the tiling guide to enable two edges of a tile to be aligned.

14. A method of tiling comprising the steps of:

establishing a line on or adjacent the surface to be tiled;

securing a tiling guide to the surface using the established line to assist alignment of the tiling guide, the tiling guide comprising surface-engaging means which enable the tiling guide to be secured to the surface, one or more substantially flat elongate portions each having a tile engaging side and a surface engaging side, and tile abutment means to align the edge of a tile, wherein the tile abutment means comprises a ridge extending away from the tile engaging side, and wherein the ridge has a T-shaped cross-section, the T-shape allowing the grout to key into the tiling guide;

applying adhesive to the surface to be tiled;

aligning one or more tiles along the tiling guide;

tiling the remainder of the surface; and applying grout to fill in space between the tiles and obscure the tiling guide from view.

15. A method of tiling according to claim 14 including rolling the tiling guide into a spiral.

16. The method of tiling according to claim 14 wherein the step of applying grout includes obscuring the tiling guide from view with the grout.

17. A pack of tiles comprising:

a) a tiling guide to aid the placement of tiles onto a surface, the tiling guide comprising:

surface-engaging means which enable the tiling guide to be secured to the surface;

one or more substantially flat elongate portions each having a tile engaging side and a surface engaging side; and tile abutment means to align the edge of a tile;

wherein the tile abutment means comprises a ridge extending away from the tile engaging side; and wherein the ridge has a T-shaped cross-section, the T-shape allowing the grout to key into the tiling guide; and b) a plurality of tiles packaged with the tiling guide.

18. A pack of tiles according to claim 17 wherein the tiling guide is sufficiently pliable that it may be rolled into a spiral when not in use.

* * * * *

UNITED STATES PATENT AND TRADEMARK OFFICE

CERTIFICATE OF CORRECTION

PATENT NO. : 6,754,972 B2
DATED : June 29, 2004
INVENTOR(S) : Donnellan

It is certified that error appears in the above-identified patent and that said Letters Patent is hereby corrected as shown below:

Column 7,
Line 3, should read -- wherein the step of applying grout includes obscuring the --

Signed and Sealed this

Seventh Day of December, 2004

JON W. DUDAS
*Director of the United States Patent and Trademark Office*